United States Patent [19]

Nadolsky

[11] 4,215,671

[45] Aug. 5, 1980

[54] FIREPLACE GRATE

[75] Inventor: Isaac Nadolsky, Castro Valley, Calif.

[73] Assignee: Bohanna & Pearce, Inc., San Leandro, Calif.

[21] Appl. No.: 944,492

[22] Filed: Sep. 19, 1978

[51] Int. Cl.[3] ..... F23H 13/00

[52] U.S. Cl. ..... 126/164; 403/391

[58] Field of Search ..... 126/137, 135, 164, 165, 126/298, 336, 152 R, 153, 154, 163, 136; D7/207; 403/391, 399, 393

[56] References Cited

U.S. PATENT DOCUMENTS

| | | | |
|---|---|---|---|
| 2,600,753 | 6/1952 | Gilbert | 126/298 |
| 3,505,986 | 4/1970 | Wood | 126/165 |
| 4,019,493 | 4/1977 | McCullough | 126/165 |
| 4,069,808 | 1/1978 | Cranberg | 126/164 |
| 4,086,905 | 5/1978 | Dawson | 126/164 |

*Primary Examiner*—James C. Yeung
*Attorney, Agent, or Firm*—Harris Zimmerman

[57] ABSTRACT

An improved grate for fireplaces and the like includes a frame having a pair of parallel, spaced longitudinal members, and a plurality of transverse members secured to the longitudinal members in parallel, spaced apart relationship. The distal ends of the transverse members extend obliquely upwardly. A pair of legs members are secured to the opposed ends of the longitudinal members by bolt clamps which also secure an expanded metal screen to the upper surface of the frame. A pair of support arms are secured to distal end portions of a pair of the transverse members, the support arms being disposed in parallel, spaced apart relationship. The support arms extend obliquely upwardly above the expanded metal screen to support a plurality of combustible logs above a bed of coals or other combustible material retained by the metal screen.

4 Claims, 5 Drawing Figures

FIREPLACE GRATE

BACKGROUND OF THE INVENTION

As the threat of a scarcity of energy becomes more real than apparent, there is increasing interest in new, often exotic sources of energy. Ironically, at the same time many individuals are returning to older, proven sources of energy which have fallen into disfavored during the era of cheap and abundant petroleum fuels. The most notable of these more traditional energy sources is firewood, a fuel source which is renewable, easy to burn, and pleasing to use.

A major criticism of the use of firewood has been that although many homes are provided with fireplaces for wood burning, the fireplace exhibits very low efficiency in converting the potential energy of the wood into useful energy in the home. It is estimated that as much as 90 percent of the heat energy of a wood burning fire in a fireplace escapes up the chimney, the remainder being radiated into the adjacent room to provide heat therefore.

The low efficiency of most wood burning fireplaces is due to the face that a fireplace relies almost exclusively upon radiation to convey heat from the fire to the room. The most efficient radiator is the hottest part of the fire. Unfortunately, the hottest part of the fire is often found at the center of the burning mass of wood, with the outer portions of the burning wood blocking the radiation which might otherwise heat the adjacent room.

Attempts have been made in the prior art to construct devices which extract more useful heat from a fireplace. These devices include arrangements for circulating room air through conductors which pass through the fireplace, as well as devices which structure the fire so that the hottest burning portion is disposed to radiate directly into the adjacent room. However, the latter group of prior art devices often rely on the logs themselves to form the desired burning configuration. As the logs are consumed by the combustion process, they must be continually rearranged to provide the optimum radiating configuration.

The following U.S. Pat. Nos. represent the prior art most pertinent to the present invention: 3,505,986; 3,612,034; 4,069,808.

SUMMARY OF THE PRESENT INVENTION

The present invention generally comprises an improved fireplace grate which is designed to increase the heating efficiency of a fireplace while maintaining or enhancing the beauty of a wood burning fire. The invention generally comprises a frame bed on which hot embers, coals, or burning logs are supported, and a pair of support arms extending obliquely above the frame bed. The arms are disposed to support a plurality of logs above the frame bed and in spaced apart relationship thereto so that the burning material on the frame bed may ignite and burn the logs resting on the support arms. The hottest portions of the fire supported on the present invention are the embers on the frame bed and the log surfaces which face the hot embers on the frame bed. All of these portions of the burning fire are in direct line of sight with the opening of the fireplace, so that a great amount of heat may be radiated out of the fireplace and into the adjacent room.

The frame bed includes a pair of parallel, spaced apart, longitudinally extending members, with a plurality of transverse members welded to the longitudinal members at intervals therealong. The transverse members are also disposed in parallel, spaced apart relationship, with the end portions thereof extending obliquely upwardly. An expanded metal screen is supported on the frame bed, spanning the central portions and like end portions of the transverse members. The screen retains hot embers and coals which otherwise would fall to the floor of the fireplace.

A pair of inverted U shaped leg members are secured to the frame bed by clamping brackets which are retained by bolt and nut assemblies. The clamping brackets also secure the expanded metal screen to the top of the frame bed.

The two support arms are secured to like ends of a pair of transverse members by means of clamping brackets which are also secured by bolt and nut assemblies. The support arms extend obliquely upwardly above the expanded metal screen, so that an array of longitudinally extending logs may be supported above and spaced apart from the burning material on the metal screen. The heat from the coals and embers on the screen maintains the combustion of the logs supported on the support arms, and the logs are ideally disposed to radiate heat energy into the adjacent room without any interference. The tier of logs on the support arms also acts to reduce heat convection up the flue of the fireplace, so that more heat is available to radiate into the adjacent room.

A BRIEF DESCRIPTION OF THE DRAWING

DESCRIPTION OF THE PREFERRED EMBODIMENT

Figure 1:
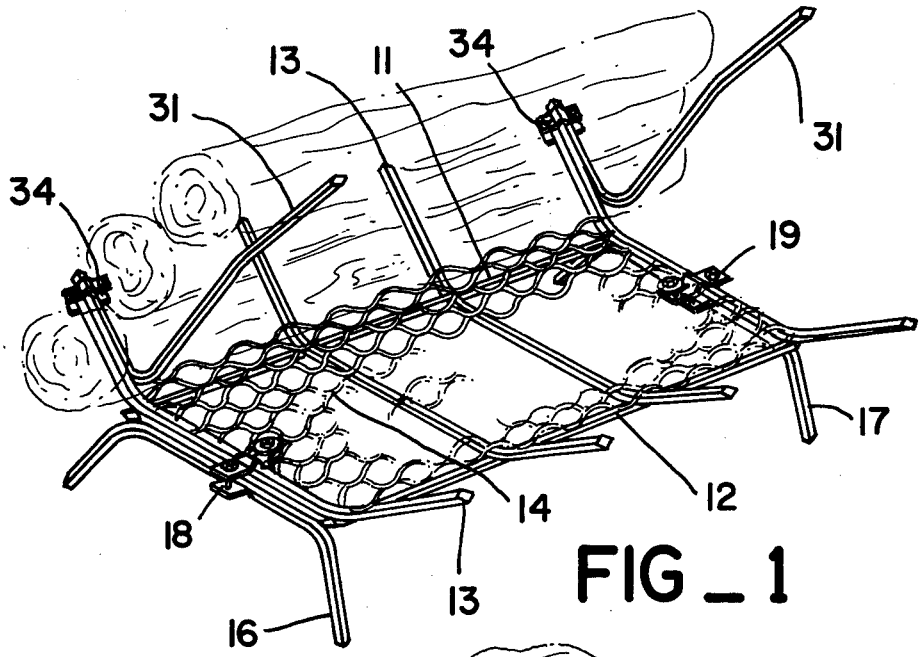
FIG. 1 is a perspective view of the fireplace grate of the present invention.
Figure 2:
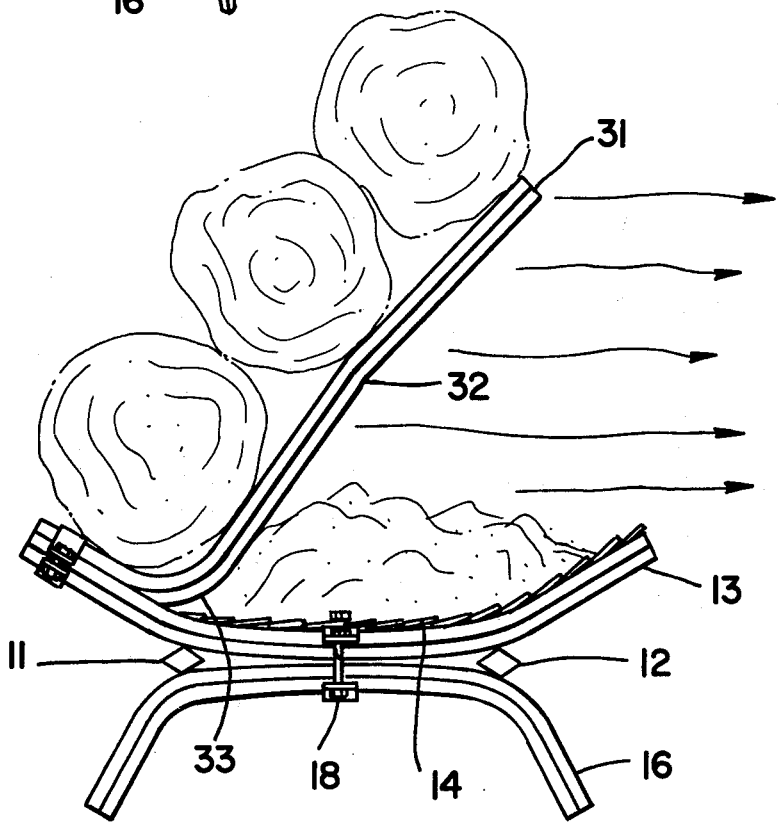
FIG. 2 is an end elevation of the fireplace grate of the present invention.

The present invention generally comprises a fireplace grate which is adapted to increase the amount of useful heat produced by a fireplace and radiated into an adjoining room. As shown in FIGS. 1 and 2, the fireplace grate includes a pair of longitudinally extending bar members 11 and 12, each of the bar members having a diamond cross-sectional configuration. The longitudinal members are arranged in parallel, spaced apart disposition and a plurality of transverse members 13 extending between the longitudinal members are secured to the upper surfaces thereof.

The transverse members 13 are also disposed in parallel, spaced apart relationship, and are also formed of bar stock having a diamond cross-sectional configuration. The transverse members include a generally linear medial portion which spans the distance between the longitudinal members 11 and 12, with the distal end portions of the transverse members extending obliquely upwardly as shown in FIGS. 1 and 2. In the preferred embodiment, the transverse members are welded to the upper surfaces of the longitudinal members to form a frame bed.

Supported on the frame bed is a screen 14 which is adapted to retain and support burning embers and coals while permitting a substantial draft therethrough. Extending from the underside of the frame bed are a pair of inverted, generally U shaped leg members 16 and 17, which are also formed of bar stock having a diamond cross-sectional configuration. A pair of clamping assemblies 18 and 19 removably secure the leg members 16 and 17 and the screen 14 to the frame bed.

Figure 3:
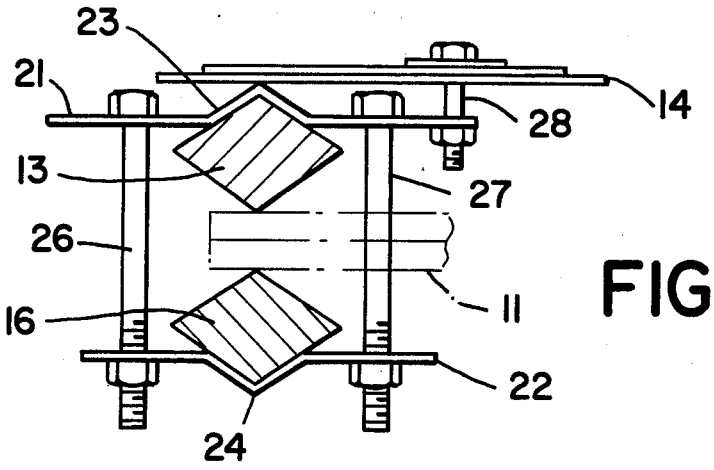
FIG. 3 is an enlarged cross-sectional view of a clamping assembly of the present invention.

As shown in FIG. 3, each of the clamping assemblies 18 and 19 include a pair of bracket members 21 and 22. The bracket members comprise generally flat metal straps which are provided with confronting, V shaped deformations 23 and 24 in the medial portions thereof. The brackets 21 and 22 also include aligned holes for receiving bolt and nut assemblies 26 and 27 which join the brackets together in compressive fashion. The V shaped portions 23 and 24 receive the diamond shaped members 13 and 16, with the compressive effect of the bolt assemblies 26 and 27 joining the leg members 16 (or 17) to the frame bed.

The distal end of the upper bracket member 21 is also provided with a hole through which a bolt, nut, and washer assembly 28 is secured. The bolt of the assembly 28 passes through the screen 14, with the washer of the assembly impinging on the screen and joining the screen to the bracket member 21. It should be noted that the entire assembly 18 or 19 is easily assembled or disassembled.

As shown in FIG. 2, the screen 14 spans the medial portions of the transverse members 13, as well as like end portions thereof. Joined to the other ends of two of the transverse members 13 are a pair of support arms 31. The support arms have a slight downward bend 32 in the medial portion thereof, as well as a generally right angular bend 33 adjacent to the lower end of the support arms. The support arms are also formed of bar stock having a diamond cross-sectional configuration.

Figure 4:
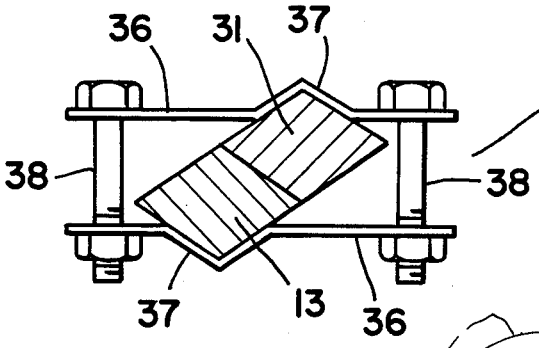
FIG. 4 is an enlarged cross-sectional view of another clamping assembly of the present invention.

The support arms 31 are joined to their respective transverse members 13 by a pair of clamping assemblies 34. As shown in FIG. 4, each clamping assembly 34 includes a pair of generally flat metal straps 36, each of which is provided with a V shaped notch 37 which is adapted to receive a vertex of one of the members 13 or 31. Each of the notches 37 is offset from the medial portion of the respective strap 36, the notches being disposed to receive the members 13 and 31 in confronting relationship with the confronting surfaces thereof in flush contact, as shown in FIG. 4.

A pair of bolt assemblies 38 join the two strap members 36 and the members 13 and 31 compressively together, the flush contact of the impinging surfaces forming a very rigid structure. It should be noted that the clamping assemblies 34 are also easily assembled or disassembled.

As shown in FIG. 2, the support arms 31 extend obliquely upwardly above the frame bed and above the screen 14. The support arms 31 are provided to support a plurality of logs which are disposed generally parallel to the longitudinal members 11 and 12, and are arrayed in an upwardly stacked relationship. It should be noted that the logs supported by the support arms 31 are thus disposed directly above the screen 14, on which there is supported hot embers, hot coals, or similar burning fuel.

The heat rising from the burning material supported on the screen 14 ignites the logs resting on the support arms 31, and maintains the combustion thereof. The portions of the logs which burn most intensely are those which face the burning on the screen 14. These intensely burning portions are maintained by the arms 31 in a disposition which permits direct thermal radiation therefrom to the adjoining room, as shown by the arrows in FIG. 2. Thus the support arms increase the amount of heat which is radiated into the room, thereby increasing the efficiency of the fire.

The screen 14 also serves to catch burning embers, and coals, which fall from the burning logs supported on the arms 31. The fire is thus self-sustaining, needing little care or redistribution of the combustible materials. It should also be noted that the upwardly extending stacked array of logs reduces the upward draft in the fireplace which is usually responsible for carrying most of the heat of the fire up the chimney. The logs also block direct thermal radiation to the back of the fireplace or up the flue, so that the efficiency of the fire is further enhanced.

Figure 5:
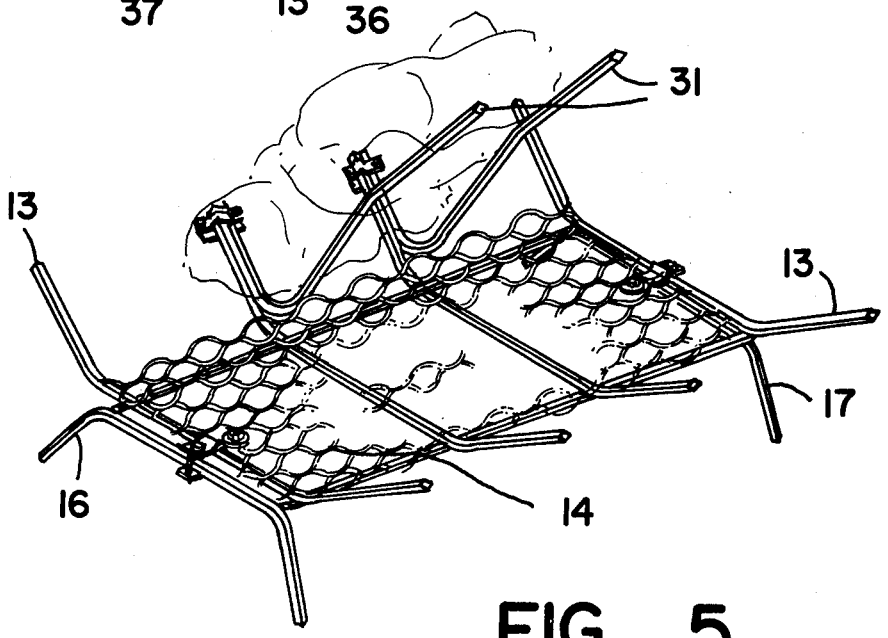
FIG. 5 is a perspective view of the fireplace grate shown in an alternative configuration.

As explained in the foregoing description, the clamping assemblies 34 are easily removable by loosening of the bolt assemblies 38. With reference to FIG. 5, the support arms may be secured to any two of the transverse members 13; for example, if shorter logs are to be burned, the support arms may be joined to the adjacent middle transverse members 13 by means of the clamping assemblies 34. For longer logs the support arms may be joined to the distal end transverse members, as shown in FIG. 1.

To utilize the fireplace grate, it is placed in a fireplace which is somewhat larger than the grate, and a plurality of logs are placed in upwardly extending stacked fashion on the support arms 31. A supply of combustible fuel is then placed directly below the stack of logs, supported on the screen 14. This combustible material may comprise kindling, coal, charcoal, or the like. The combustible material resting on the screen 14 may be ignited by any conventional means, and the burning of this material will kindle the logs resting on the support arms. The fire will then be self-sustaining, with a substantial portion of the radiant energy therefrom being directed out of the fireplace and into the ajoining room.

It should be noted that the support arms as well as the legs members 16 and 17 are removable from the frame bed. Disassembly of the fireplace grate of the present invention facilitates moving and relocation of the grate, and also permits the disassembled fireplace grate to be packaged in a compact box which is convenient for display, shipping, and carrying.

I claim:

1. An improved fireplace grate, comprising a pair of longitudinal members disposed in parallel, spaced apart relationship, a plurality of transverse members disposed in parallel, spaced apart fashion orthogonal to said longitudinal members and supported thereon, said transverse members each including a substantially linear medial portion and opposed distal end portions extending obliquely upwardly therefrom, said linear portions being disposed in spaced, adjacent fashion to define a frame bed, screen means supported on said frame bed for retaining coals and fuel undergoing combustion, a pair of support arms joined at their lower ends to like distal ends of any pair of said plurality of transverse members, said support arms extending obliquely upwardly above said frame bed to support a plurality of logs generally parallel to said longitudinal members in vertically stacked relationship above said frame bed, wherein said transverse members and said supports arms are formed of bar stock having at least one planar surface, first clamping means for releasably joining said support arms and said transverse members with their respective planar surfaces in confronting impingement, said first clamping means further including a pair of parallel strap members having V notches therein to receive said support arm and said transverse members, said V notches being laterally offset each from the other.

2. The fireplace grate of claim 1, wherein said frame bed includes a pair of leg members extending downwardly therefrom and second clamping means for securing said leg members and said screen means to said frame bed.

3. The fireplace grate of claim 2, wherein said second clamping means includes a pair of parallel strap members having confronting V notches therein to receive said leg member and said transverse member, one of said strap members being adapted to retain bolt means extending through said screen means.

4. The fireplace grate of claim 1, wherein said screen means includes an expanded metal screen.

* * * * *